US009939225B2

(12) United States Patent
Ravnaas

(10) Patent No.: US 9,939,225 B2
(45) Date of Patent: Apr. 10, 2018

(54) FIREARM STOCK WITH SUPPORT

(71) Applicant: Brent J. Ravnaas, Turtle Lake, ND (US)

(72) Inventor: Brent J. Ravnaas, Turtle Lake, ND (US)

( * ) Notice: Subject to any disclaimer, the term of this patent is extended or adjusted under 35 U.S.C. 154(b) by 0 days.

(21) Appl. No.: 14/893,758

(22) PCT Filed: May 27, 2014

(86) PCT No.: PCT/US2014/039587
§ 371 (c)(1),
(2) Date: Nov. 24, 2015

(87) PCT Pub. No.: WO2014/190350
PCT Pub. Date: Nov. 27, 2014

(65) Prior Publication Data

US 2016/0116245 A1 Apr. 28, 2016

Related U.S. Application Data

(60) Provisional application No. 61/827,414, filed on May 24, 2013.

(51) Int. Cl.
*F41A 23/08* (2006.01)
*F41C 23/16* (2006.01)
(Continued)

(52) U.S. Cl.
CPC ..... *F41A 23/08* (2013.01); *F41C 23/16* (2013.01); *F41C 23/20* (2013.01); *F41C 23/22* (2013.01)

(58) Field of Classification Search
CPC ..... F41A 23/02; F41A 23/10; F41A 23/08; F41A 23/06; F41A 23/04; F41A 23/14; F41A 23/23; F41C 27/00; F41C 23/22
(Continued)

(56) References Cited

U.S. PATENT DOCUMENTS 2,441,487 A * 5/1948 Howard ..... F41C 23/04 42/72
2,484,168 A * 10/1949 Jachimiec ..... F41C 23/22 42/71.01
(Continued)

FOREIGN PATENT DOCUMENTS

WO WO 2014190350 A1 * 11/2014 ..... F41A 23/08

OTHER PUBLICATIONS

International Search Report and Written Opinion of PCT/US2014/039587, dated Oct. 3, 2014.

*Primary Examiner* — Benjamin P Lee
(74) *Attorney, Agent, or Firm* — Briggs and Morgan, P.A.; Audrey J. Babcock

(57) ABSTRACT

A firearm stock with a support such as a bipod, tripod, monopod, or aiming stick is described. The support includes support legs and a mounting structure which mounts the support legs onto the stock. The support legs may be detached from the mounting structure when the support is not in use. After removal from the mounting structure, the support legs may be stored in one or more channels in the stock, by sliding them through one or more apertures in the end of the butt of the stock. The mounting structure may include a swivel mechanism which allows the aiming of the rifle to be adjusted while the support legs remain engaged with the ground.

19 Claims, 12 Drawing Sheets

(51) Int. Cl.
*F41C 23/22* (2006.01)
*F41C 23/20* (2006.01)

(58) Field of Classification Search
USPC ..... 42/90, 94, 85; 89/37.01
See application file for complete search history.

(56) References Cited

U.S. PATENT DOCUMENTS 3,011,283 A * 12/1961 Lunn ..... F41C 23/00 42/71.01
4,776,124 A * 10/1988 Clifton ..... F41A 23/08 42/94
5,029,407 A * 7/1991 Kirkpatrick ..... F41A 23/10 42/94
5,068,991 A * 12/1991 Reed ..... F41C 23/22 42/71.01
5,225,613 A * 7/1993 Claridge ..... F41C 23/22 42/74
5,852,892 A * 12/1998 Bilgeri ..... F41A 23/08 42/72
6,289,622 B1 * 9/2001 Desch, Jr. ..... F41A 23/10 42/94
6,843,015 B2 * 1/2005 Sharp ..... F41A 23/10 211/203
7,676,979 B1 * 3/2010 Mertz ..... F41A 23/08 42/71.01
7,770,320 B1 * 8/2010 Bartak ..... F41A 23/08 42/72
7,992,339 B2 * 8/2011 Hinds, Jr. ..... F41A 23/10 42/94
8,327,570 B2 12/2012 Potterfield et al.
8,567,106 B2 * 10/2013 Chvala ..... F41A 23/10 248/169
9,121,665 B2 * 9/2015 Hinds ..... F41A 23/04
2006/0248774 A1 11/2006 Pierce et al.
2007/0079541 A1 4/2007 Peterson
2008/0307689 A1 * 12/2008 Dotson ..... F41A 23/06 42/94
2010/0192449 A1 * 8/2010 Hinds, Jr. ..... F41A 23/10 42/94
2010/0205845 A1 8/2010 Bartak
2011/0113666 A1 5/2011 Latimer

* cited by examiner

FIREARM STOCK WITH SUPPORT

TECHNICAL FIELD

The present invention relates to a firearm support system including the stock of a firearm and a support such as a bipod. The legs of the support may be detached from the firearm and inserted into the stock for storage.

BACKGROUND OF THE INVENTION

Supports such as bipods, tripods, monopods, and aiming sticks have been used in conjunction with firearms, including rifles, shotguns, and handguns, in order to stabilize the firearm and facilitate accurate aiming of the firearm. When used with a shotgun or rifle, supports are commonly mounted to the firearm at the underside of the forearm, or fore-end, of the stock. In some circumstances, supports may also be mounted to the barrel of a firearm.

Supports may be designed to remain attached to the firearm even when the supports are not in use, or they may be designed to be removed for storage. An example of a firearm with a bipod which remains attached to the forearm of the stock is described in U.S. Pat. No. 7,992,339. That patent describes a firearm wherein the legs of the bipod extend downward from the stock when the bipod is in use. When the bipod is not in use, the bipod legs may pivot to an extended position approximately parallel to the barrel of the firearm. In this extended position, the bipod legs are aligned with channels in the forearm of the stock. The bipod legs may then be pushed into the channels in the forearm for storage. The bipod legs remain attached to the firearm during storage, and during the transition from storage to use and from use to storage.

Other examples of firearms with bipods which may be stored in the forearm of the stock are described in U.S. Pat. Nos. 7,770,320, 4,776,124, and U.S. Patent Application Publication No. 2008/0307689. Each of these references describe bipods with legs which may pivot or rotate from a position in which the bipod legs extend downward from the stock, to an extended position in which the bipod legs are approximately parallel to the barrel and aligned with channels in the forearm of the stock. The bipod legs may then be inserted into the channels in the forearm for storage.

SUMMARY OF THE INVENTION

The present invention is directed to a firearm support system. This support system includes a firearm stock and a support such as a bipod, tripod, monopod, or aiming stick. The firearm stock of the present invention may be the stock of various firearms, including but not limited to the stock of a rifle or a shotgun. The legs of the support, or support legs, may be detached from the firearm when the support is not in use. After removal from the firearm, the support legs may be stored in one or more channels in the stock, by sliding them through one or more apertures in the end of the butt of the stock. In one embodiment, only the support legs (such as bipod legs) are removed and stored by sliding them into channels in the stock, while the mounting structure which mounts the support legs to the firearm remains attached to the firearm. In another embodiment, the entire support, including the mounting structure, may be removed from the firearm. In one embodiment, the mounting structure, as well as the support legs, may be stored within the stock. The mounting structure may be mounted to the end of the forearm of the stock which is opposite to the butt of the stock. Alternatively, the mounting structure may be incorporated into the stock. The mounting structure may include a swivel mechanism which allows the aiming of the rifle to be adjusted while the support legs remain engaged with the ground.

The present invention is directed to a firearm support system including a firearm stock having a forearm and a butt, the butt having a distal end opposite from the forearm, wherein the distal end of the butt comprises an aperture, and a channel extends from the aperture into the firearm stock. The firearm support system also includes a support, which includes a support leg and a mounting structure for attaching the support leg to the forearm, wherein the support leg is detachable from the mounting structure, and wherein the channel is adapted to store the support leg after the support leg is detached from the mounting structure.

The present invention is also directed to a firearm support system including a firearm stock having a forearm and a butt, the butt having a distal end opposite from the forearm, wherein the distal end of the butt comprises a first aperture and a second aperture, and wherein a first channel extends from the first aperture into the firearm stock, and a second channel extends from the second aperture into the firearm stock. The firearm support system also includes a first support leg, a second support leg, and a mounting structure for releasably attaching the first support leg and the second support leg to the forearm, and wherein the first channel is adapted to store the first support leg after the first support leg is removed from the mounting structure, and the second channel is adapted to store the second support leg after the second support leg is removed from the mounting structure.

An advantage of the present invention is that it allows the forearm of the stock to be of normal size, in comparison to forearms adapted to store supports or support legs, because the forearm of the stock of the present invention does not need to be large enough to allow room for support storage. Another advantage of the present invention is that it places the weight of the stored support or support legs in the rear of the firearm, instead of in the forearm of the stock. Placing additional weight in the forearm tends to result in firearms which are off-balance, making them more difficult to aim. Many firearms are already weighted towards the front, or barrel end, of the firearm even without an additional weight, and placing additional weight in the forearm only exacerbates the forward-heavy nature of these firearms. Placing the weight of the support or support legs in the rear of the firearm, in accordance with the present invention, creates a better balance.

The present invention is further directed to a handgun with a support such as a bipod, tripod, monopod, or aiming stick. The handgun of the present invention may be, but is not limited to, a pistol or a revolver. The legs of the support, or support legs, may be detached from the handgun when the support is not in use. After removal from the handgun, the support legs may be stored in one or more channels of the handle, by sliding them through one or more apertures in the base of the handle. In one embodiment, only the support legs (such as bipod legs) are removed and stored by sliding them into channels in the handle, while the mounting structure which mounts the support legs to the handgun remains attached to the handgun. In another embodiment, the entire support, including the mounting structure, may be removed from the handgun. In one embodiment, the mounting structure, as well as the support legs, may be stored within the handle.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
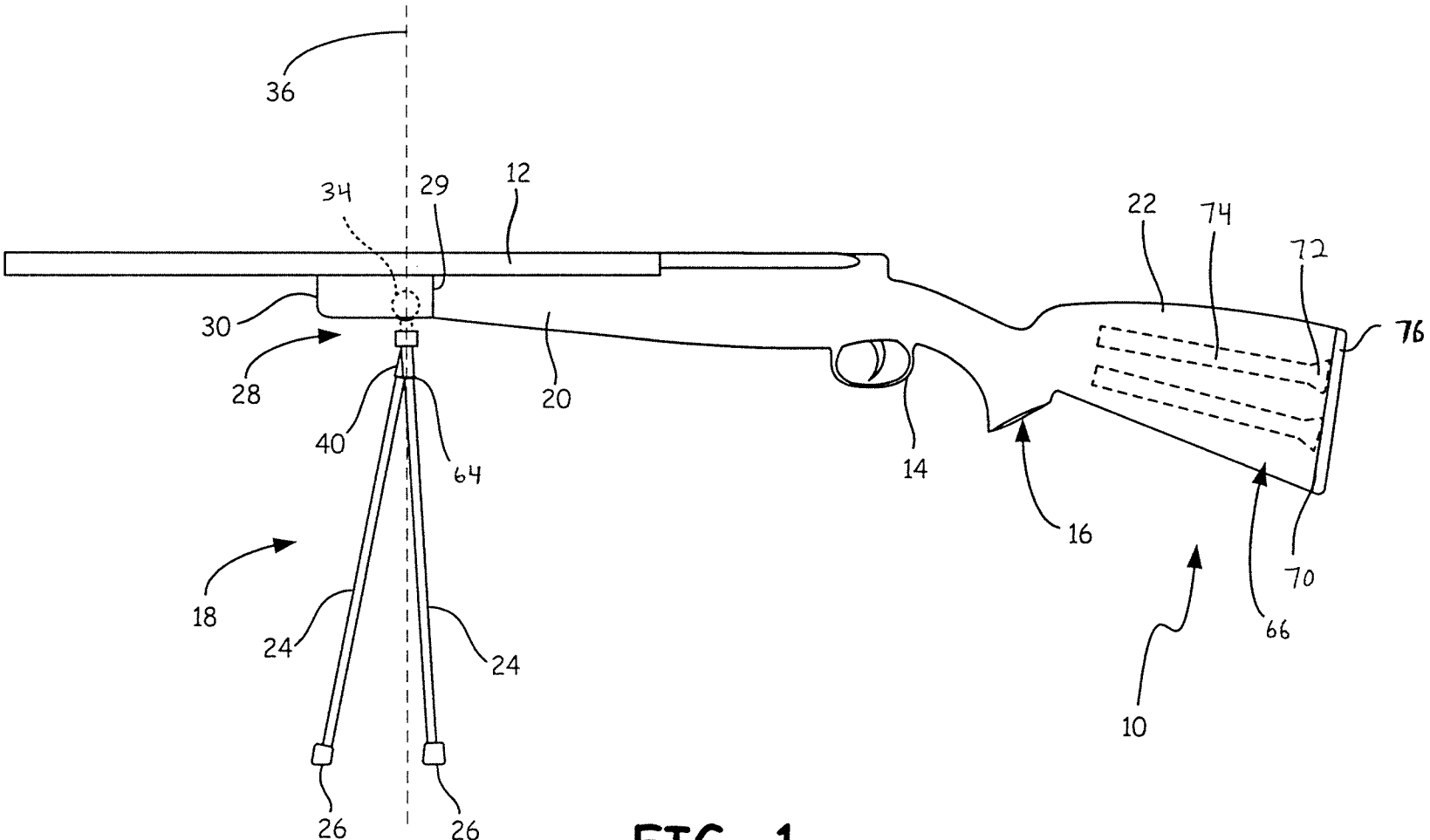
FIG. 1 is a side elevational view of a rifle including a stock and support of the present invention, with the support in a use position.
Figure 2:
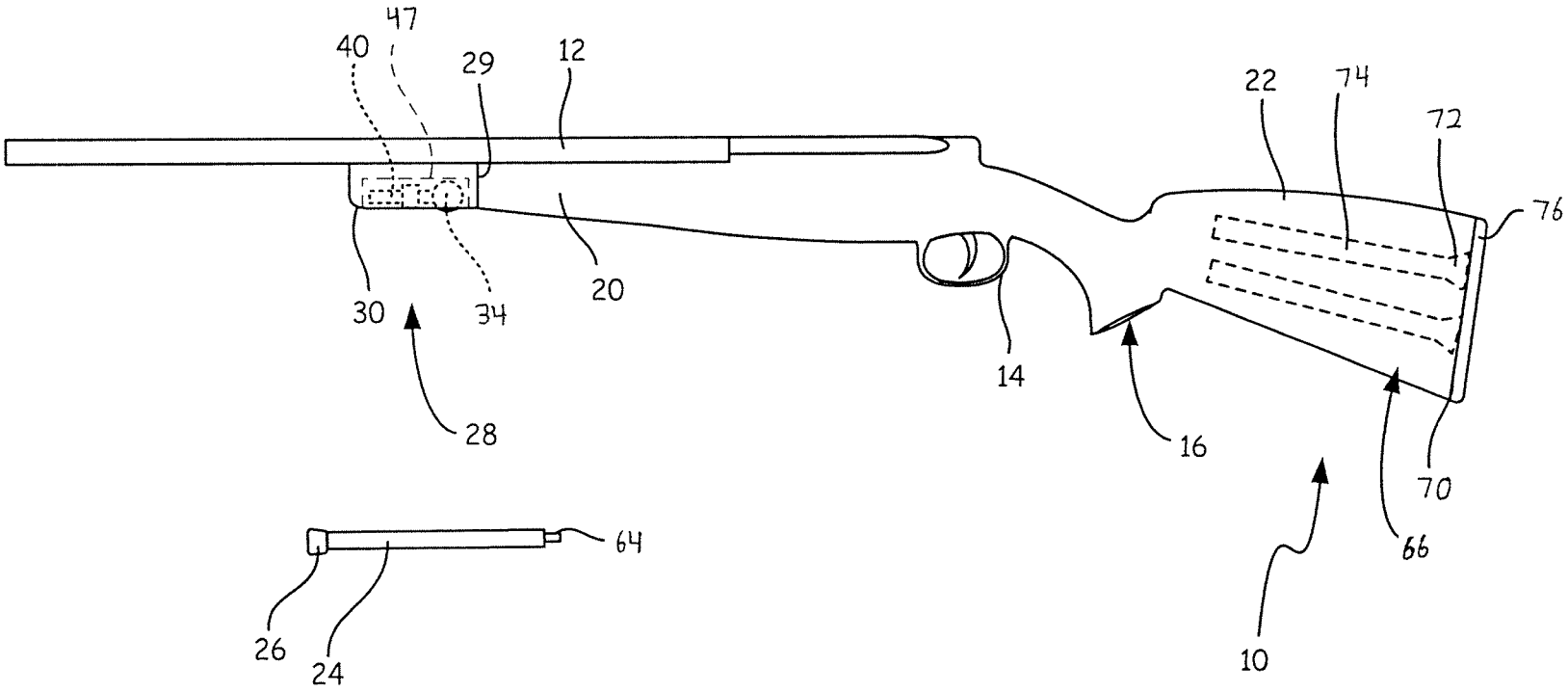
FIG. 2 is a side elevational view of the rifle of FIG. 1, with the support legs detached and the mounting structure in a folded position.

FIGS. 1 and 2 depict a rifle 10, including a barrel 12, trigger device 14, and stock 16. The stock 16 and support 18 shown in FIG. 1 are an example of an embodiment of the present invention. Stock 16 includes a fore-end or forearm 20 and a rear portion or butt 22. The stock 16 may be in one piece (i.e., it may be constructed from one piece of wood), or the stock 16 may be made from two or more pieces which are secured to each other. The support 18 includes support legs 24 and a mounting structure 28. A support foot 26 is attached to the end of each support leg 24 to engage the ground or another surface, and to provide stability when the support 18 is in use. In FIG. 1, the support 18 is in a use position, in which the support legs 24 extend downward such that the support feet 26 are able to engage the ground or other surface. In the use position, the support 18 is able to provide stability to the rifle 10 to improve accuracy in aiming. In FIG. 2, the mounting structure 28 is in a folded position, and the support legs 24 are detached from the mounting structure 28.

The support legs 24 are telescoping legs. In FIG. 1, the support legs 24 are extended to their full length and locked in the extended position, whereas in FIG. 2, the support legs 24 are contracted and locked in the contracted position. The telescoping feature of the support legs 24 allows them to become long enough, when extended, for the support 18 to be used when a user aims the rifle 10 while sitting or standing. The telescoping feature also allows the support 18 to become short enough, when contracted, for the support 18 to be used when a user aims the rifle 10 while lying down. In other embodiments, the support legs 24 may not be telescoping legs. Support legs 24 that are not telescoping could be used in supports 18 which are intended to be used when a user aims the rifle 10 while lying down.

In the embodiment shown in the figures, the support 18 is a bipod and therefore includes two support legs 24. However, in other embodiments of the present invention, the support 18 may include a different number of support legs 24. For example, a support 18 in accordance with the present invention may be a monopod, including one support leg 24, or a tripod, including three support legs 24.

The support 18 also includes a mounting structure 28 which attaches the support legs 24 to the forearm 20. In the embodiment shown in FIG. 3, the mounting structure 28 is mounted onto the distal end 29 of the forearm 20, which is at the end of the forearm 20 opposite to the butt 22 of the stock 16. In some embodiments, the mounting structure 28 may be mounted to the underside of the forearm 20, rather than onto the distal end 29. In other embodiments, the mounting structure 28 may be mounted on the barrel 12 or on another component of rifle 10, rather than on the forearm 20.

A variety of different structures may function as the mounting structure 28. In the embodiment shown in FIGS. 1-3, the mounting structure includes a housing 30. The housing 30 is secured to the distal end 29 of the forearm 20 by threaded fasteners passing through housing apertures 32 (shown in FIG. 3) extending through the housing. In an alternative embodiment, instead of the mounting structure 28 including a housing 30 which is separable from the stock 16, the housing 30 and stock 16 may form one unitary structure.

Figure 3:
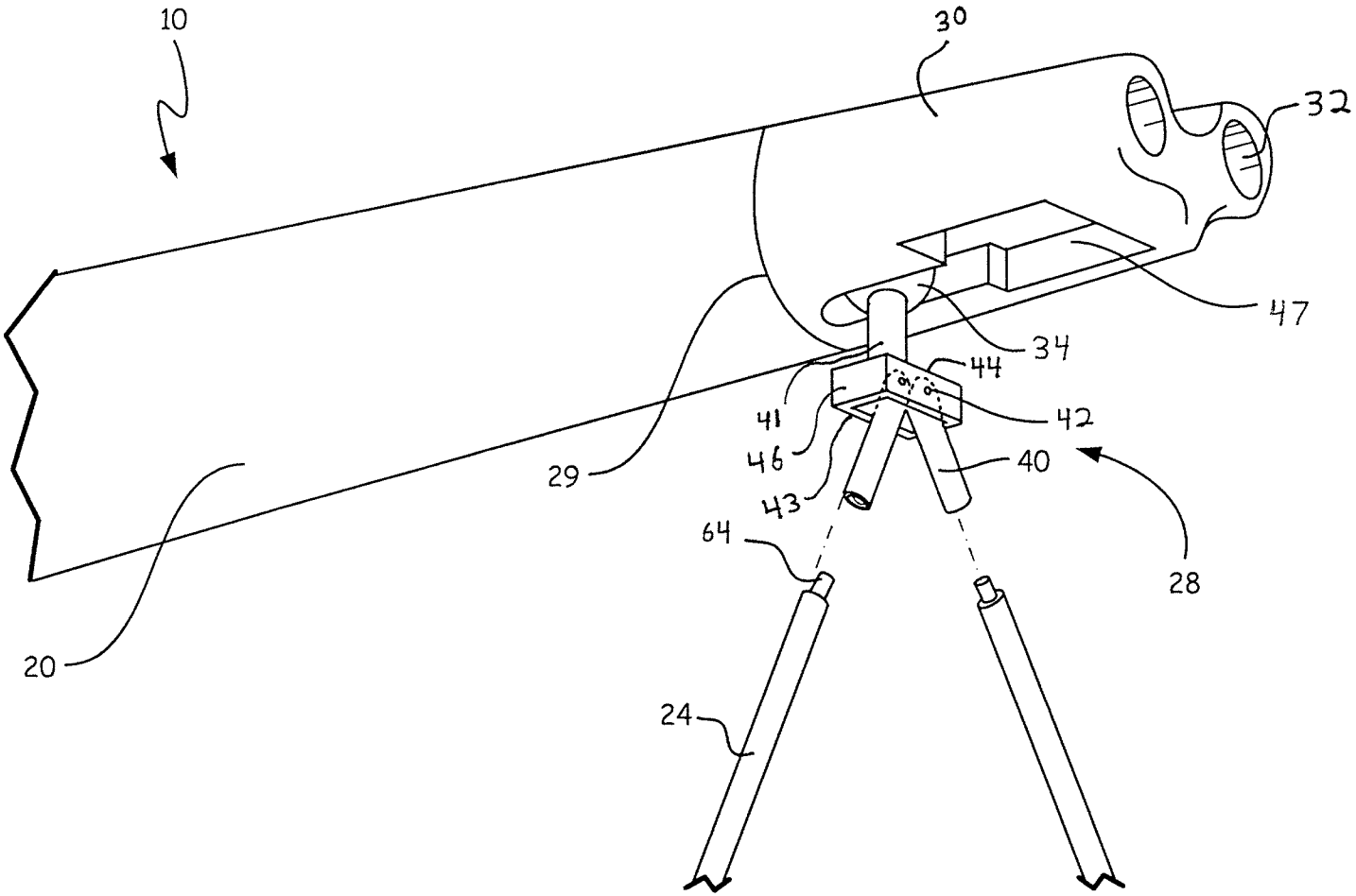
FIG. 3 is a perspective view of the mounting structure of the support of FIG. 1, with the mounting structure in a use position.

In the embodiment shown in FIG. 3, the mounting structure 28 includes a swivel mechanism. The swivel mechanism shown in FIG. 3 is a ball joint 34, but in different embodiments the swivel mechanism may have different forms. The ball joint 34 allows the housing 30, and therefore the rifle 10, to be rotated about an axis 36 (indicated in FIG. 1) which is substantially perpendicular to the barrel 12, when the support 18 is in a use position. Accordingly, the rifle 10 may be rotated about a pivot point in the ball joint 34, while the support legs 24 remain in place and the support feet 26 remain engaged with the ground. The ball joint 34 allows the barrel 12 of the rifle 10 to be moved in all directions (i.e. up-and-down as well as side-to-side), thereby allowing the user to fine-tune the aiming of the rifle 10 without altering the position of the support legs 24. In addition to, or instead of, including a ball joint 34 in the mounting structure 28, the support legs 24 may be constructed of a material which allows the support legs 24 to flex. If the support legs 24 are able to flex, the rifle 10 may be moved slightly while the support feet 26 remain engaged with the ground, thereby allowing the user to fine-tune the aiming of the rifle 10.

One receiver 40 is included in the mounting structure 28 for each support leg 24. The receivers 40 releasably attach the support legs 24 to the remainder of the mounting structure 28. The receivers 40 may be a fixed length. Alternatively, the receivers 40 may be telescoping receivers. Telescoping receivers may be extended when the support 18 is in use, and contracted when the support 18 is in a folded position. Receivers 40 are connected to the ball joint 34 by a link or connector 41, receiver hinge pins 42, and a hinge casing 43. The connector 41 extends from the ball joint 34. The end of connector 41 which is opposite to the ball joint 34 may be threaded, and an aperture through the top wall 44 of the hinge casing 43 may also be threaded to secure the hinge casing 43 to the connector 41. Alternatively, the hinge casing 43 may be permanently secured to the connector 41, such as by welding, or the connector 41 and hinge casing 43 may form one unitary structure.

Figure 4:
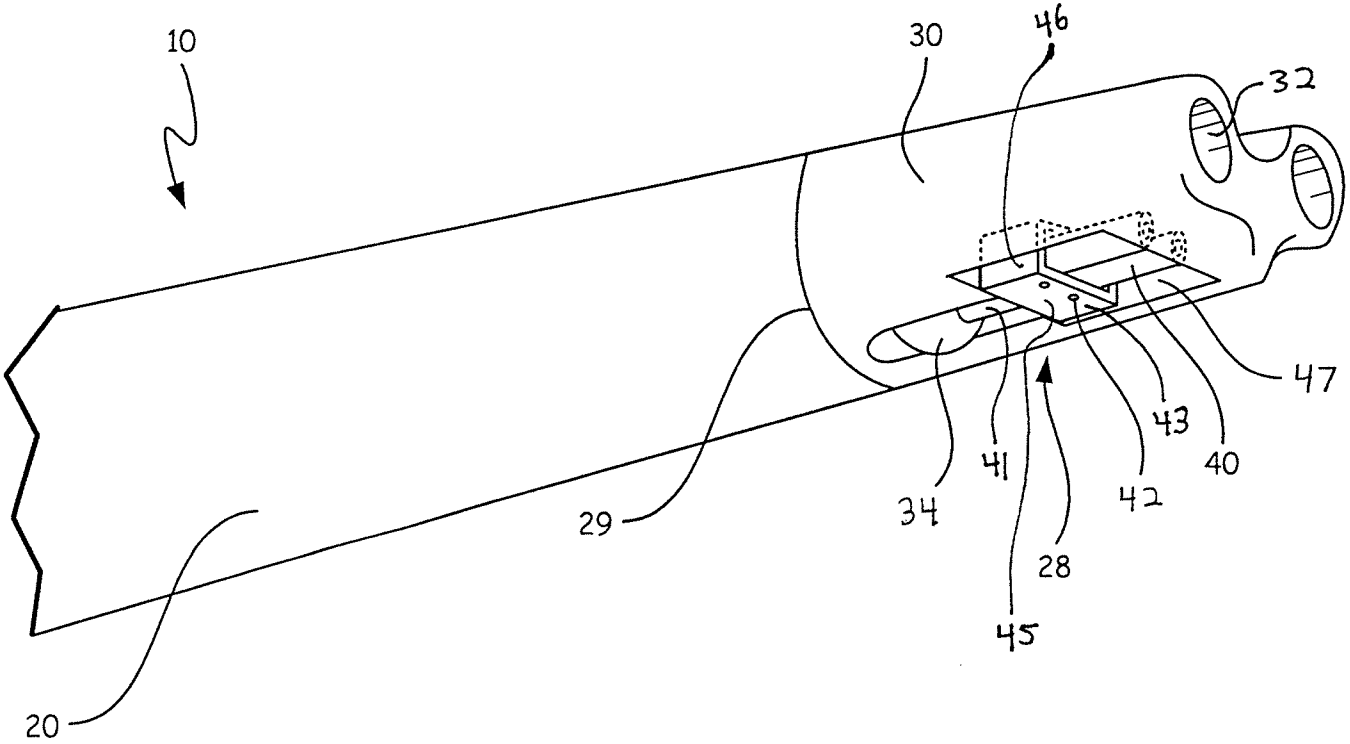
FIG. 4 is a perspective view of the mounting structure of the support of FIG. 1, with the mounting structure in a folded position.

A receiver hinge pin 42 passes through each receiver 40 and is attached to the side walls 45 of the hinge casing 43. The receiver hinge pins 43 allow the receivers 40, and consequently the support legs 24, to splay outward when the support 18 is in the use position, as shown in FIG. 3, and to be substantially parallel to each other when the support 18 is in a folded position, as shown in FIG. 4. The receivers 40 may be permanently connected to the remainder of the mounting structure 28, as shown in FIGS. 3 and 4, or they may be releasably secured by a releasable fastening means.

The hinge casing 43 includes end walls 46. In an alternative embodiment, the hinge casing 43 may not include end walls 46, in order to allow the receivers 40, and consequently support legs 24, to splay outward to a greater extent without interference from end walls 46. Moreover, in some embodiments, the hinge casing 43 may not have a box-like structure of the type shown in FIG. 3. For example, the hinge casing could comprise a plate attached to connector 41, with hinges connecting the hinge casing to the receivers 40. Alternatively, rather than including one hinge structure for each receiver 40, one hinge structure which allows both receivers 40, when extended, to splay outward could be linked to the ball joint 34.

Figure 5:
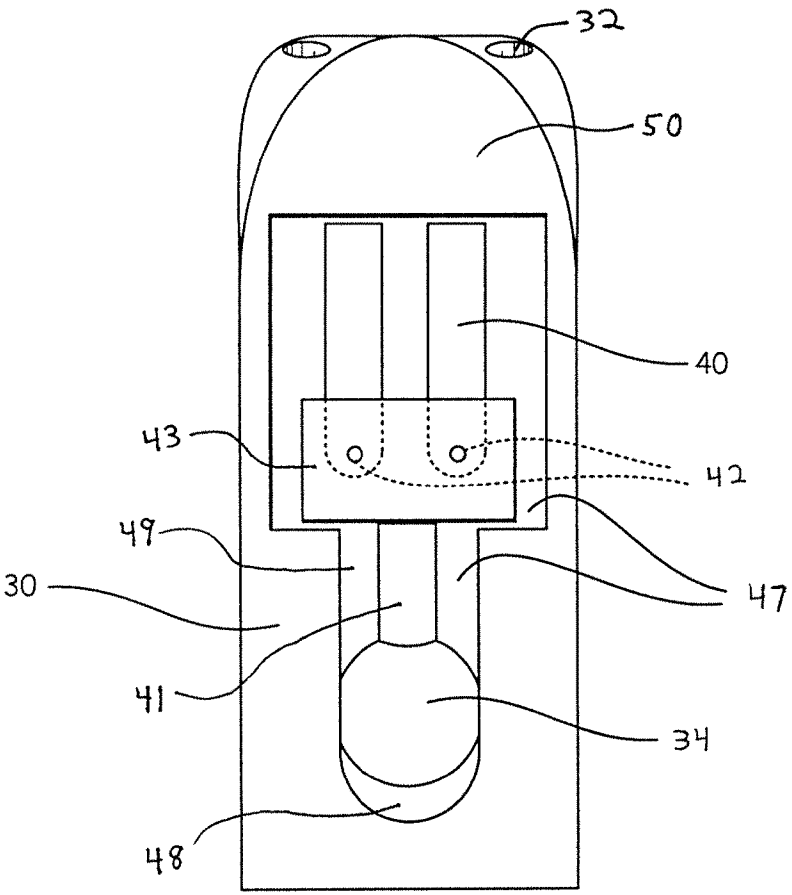
FIG. 5 is a bottom view of the mounting structure of the support of FIG. 1, with the mounting structure in a folded position.

While FIG. 3 shows the mounting structure 28 in a use position, with the receivers 40 extending downward from the housing 30 to allow the support legs 24 to engage the ground and provide support for rifle 10, FIGS. 4 and 5 show the mounting structure 28 in a folded position. FIG. 4 is a perspective view of the mounting structure 28 in a folded position, and FIG. 5 is a bottom view. The ball joint 34 allows the connector 41 and hinge casing 43, and consequently the attached receivers 40, to be folded from a position extending downward from (i.e. substantially perpendicular to) the forearm 20 to a position extending substantially parallel to the barrel 12. Therefore, the ball joint 34 allows the support 18 to transition from a use position, as shown in FIG. 1, to a folded position, as shown in FIG. 2, and vice versa.

As shown in FIGS. 3-5, housing 30 includes a cavity 47. When the support legs 24 are removed from the receivers 40, the ball joint 34 allows the connector 41, hinge casing 43, and receivers 40 to be folded up into the cavity 47 of the housing 30. As shown in FIG. 5, the cavity 47 includes a space 48 behind the ball joint 34. When the support 18 is in use with the support legs 24 supporting the rifle, the space 48 allows the barrel 12 to be pointed upwards further without contact between the connector 41 and housing 30. There is also space 49 in the cavity 47 at either side of the connector 41, so that when the support 18 is in use, the barrel 12 can be pointed downward and moved side-to-side to some extent without contact between the connector 41 and housing 30. Accordingly, the spaces 48 and 49 around the mounting structure 28 in the cavity 47 allow the mounting structure 28, and consequently the barrel 12, to have a greater freedom of motion when the support 18 is in use. A greater freedom of motion may be especially important when the support 18 is used on uneven terrain.

In an alternative embodiment, the housing 30 and stock 16 may form one unitary structure. In such an embodiment, the cavity 47 would be located in the bottom of the forearm 20 of the stock 16, and the ball joint 34 would be connected directly to the forearm 20, rather than to a housing 30.

In the embodiment shown in FIG. 5, the cavity 47 is closed on all sides except for the bottom side. The housing 30 includes a front portion 50 between the cavity 47 and the distal end of the housing. In an alternative embodiment, the cavity 47 may extend through the front portion 50 of the housing 30. This would allow the support legs 24 to remain attached to the receivers 40 when the support 18 is in a folded position. Specifically, after use of the support 18, the support legs 24 could be contracted, and the support 18 could then be folded up so that the connector 41, hinge casing 43, and receivers 40 were located in the cavity 47. Depending on the length of the housing 30 and contracted support legs 24, all or a portion of the support legs could also be located in the cavity 47. In a folded position, if the support legs 24 remained attached to the receivers 40, the support legs 24 would be substantially parallel to the barrel 12, being near to the barrel 12 without being in direct contact with the barrel. In other embodiments, the support legs 24 may be in direct contact with the barrel 12 when the support 18 is in the folded position.

Figure 6:
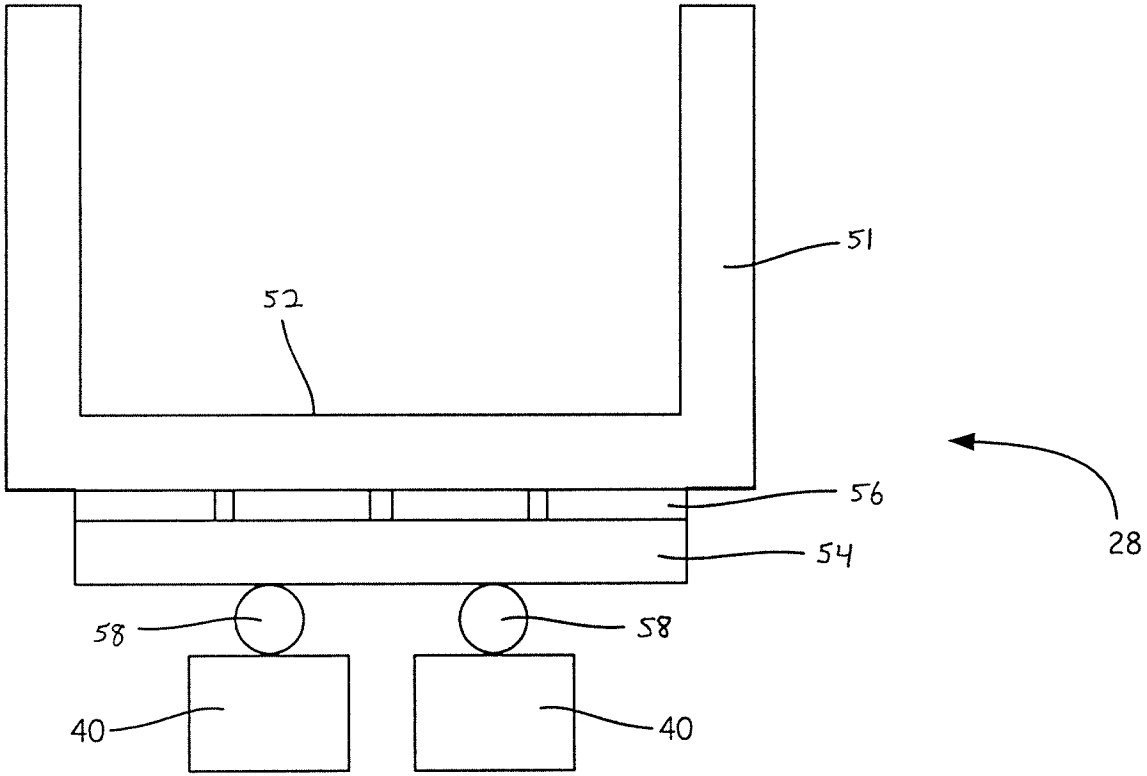
FIG. 6 is a diagram of a top view of a mounting structure of a second embodiment of the present invention, with the mounting structure in a folded position.

As stated above, a variety of different structures may function as the mounting structure 28. A diagram of an alternative embodiment of the mounting structure 28, when the support 18 is in the folded position, is shown in FIG. 6. In this embodiment, the mounting structure 28 does not include a housing 30. As shown in FIG. 6, the mounting structure 28 includes a mounting bracket 51 which attaches the remainder of the mounting structure 28 to the forearm 20. The mounting bracket 51 may be removably attached to the forearm 20, such as by a clamping mechanism. Alternatively, the mounting bracket 51 may be permanently attached to the forearm 20, or the mounting bracket and the stock 16 may form one unitary structure. As shown in FIG.

6, the inner edge 52 of the mounting bracket 51 is flat to accommodate a flat distal end 29 of forearm 20. However, in other embodiments, the inner edge 52 may be curved to accommodate a forearm 20 with a curved distal end 29. If a housing 30, as shown in FIGS. 1-5, is used, the edge of the housing 30 which contacts the distal end 29 of forearm 20 may also be flat or curved in order to accommodate differently shaped distal ends 29.

In the embodiment shown in FIG. 6, a swivel mechanism 54 is attached to the mounting bracket 51 by a hinge 56. The swivel mechanism 54 allows the mounting bracket 51, and therefore the rifle 10, to be rotated about an axis 36 (indicated in FIG. 1) which is substantially perpendicular to the barrel 12, when the support 18 is in a use position. Accordingly, the rifle 10 may be rotated about a pivot point in the swivel mechanism 54, while the support legs 24 remain in place and the support feet 26 remain engaged with the ground. In some embodiments, the swivel mechanism 54 allows the barrel 12 of the rifle 10 to be moved in all directions (i.e. up-and-down as well as side-to-side), thereby allowing the user to fine-tune the aiming of the rifle 10 without altering the position of the support legs 24. In addition to, or instead of, including a swivel mechanism 54, the support legs 24 may be constructed of a material which allows the support legs 24 to flex. If the support legs 24 are able to flex, the rifle 10 may be moved slightly while the support feet 26 remain engaged with the ground, thereby allowing the user to fine-tune the aiming of the rifle 10.

The hinge 56 allows the mounting structure 28 to transition between a use position, in which the support 18 supports a rifle 10 as shown in FIG. 1, and a folded position, in which the mounting structure 28 is folded up toward the barrel 12 of the rifle as shown in FIG. 2. Alternatively, the swivel mechanism 54 may be attached to the mounting bracket 51 by another fastening means which allows the mounting structure 28 to transition between the folded position and the use position, such as a bracket including a pivot pin.

Preferably, the receivers 40 are connected to the swivel mechanism 54 in such a way that the receivers 40, and consequently the support legs 24, splay outward when the support 18 is in a use position, but are substantially parallel to each other when the support 18 is in a folded position. For example, each receiver 40 may be attached to the swivel mechanism 34 by a receiver hinge 58, as shown in FIG. 6, which allows the receivers 40 to splay outward so that the support feet 26 are set apart from each other when the support 18 is in the use position. In another embodiment, the receivers 40 may be attached to the swivel mechanism 54 by brackets including pivot pins.

In an alternative embodiment which does not include a ball joint 34 or swivel mechanism 54, the receivers 40 may be connected directly to a housing 30 or mounting bracket 51 by hinges, or by another fastening means which allows the receivers 40 to transition between a folded position and a use position, such as brackets including pivot pins.

Figure 7:
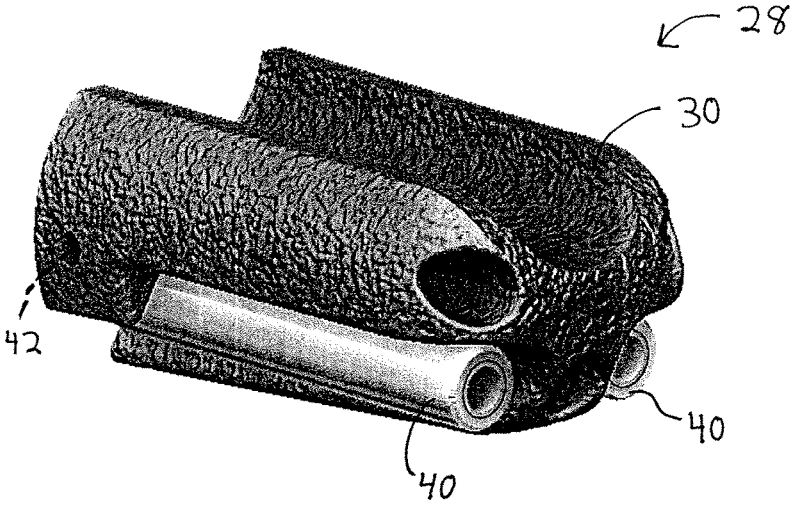
FIG. 7 is a perspective view of a mounting structure of a third embodiment of the present invention, with the mounting structure in a folded position.
Figure 8:
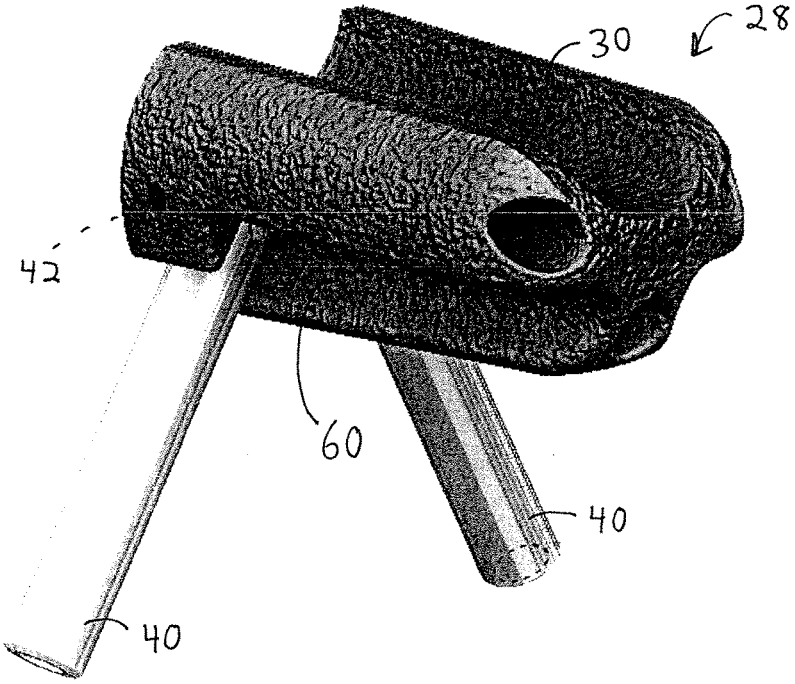
FIG. 8 is a perspective view of the mounting structure of FIG. 7, with the mounting structure in a use position.

An embodiment in which the receivers 40 are connected directly to a housing 30 is shown in FIGS. 7-12. FIG. 7 is a perspective of a mounting structure 28 with receivers 40 in a folded position, while FIG. 8 is a perspective view of the mounting structure with the receivers in a use position. The embodiment of mounting structure 28 shown in FIGS. 7 and 8 includes a housing 30 and two receivers 40. A receiver hinge pin 42 connects each receiver to the housing 30. Each receiver hinge pin 42 is set at an angle so that when the receivers 40 are in the use position, the receivers 40 splay outward. Each receiver 40 rests in a recess 60 in the housing 30 when the receivers are in the folded position.

Figure 9:
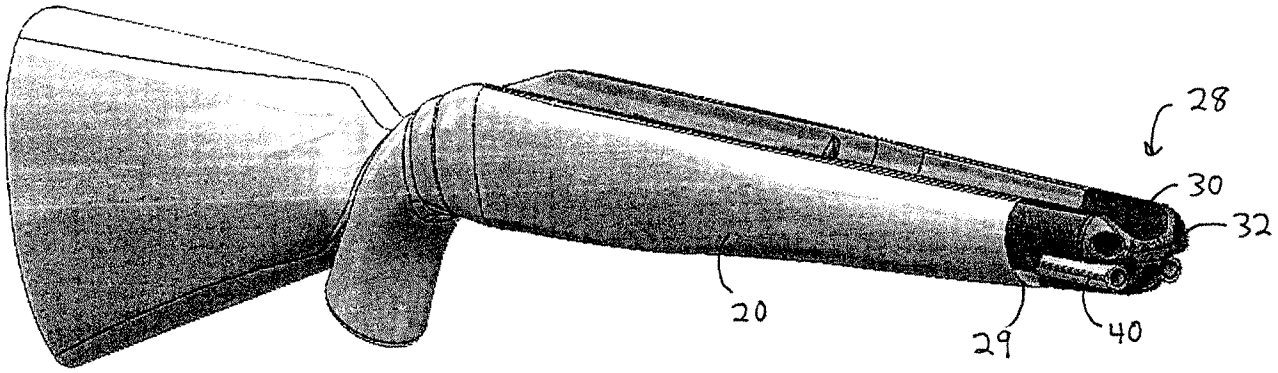
FIG. 9 is a perspective view of the mounting structure of FIG. 7 attached to a firearm stock, with the mounting structure in a folded position.
Figure 10:
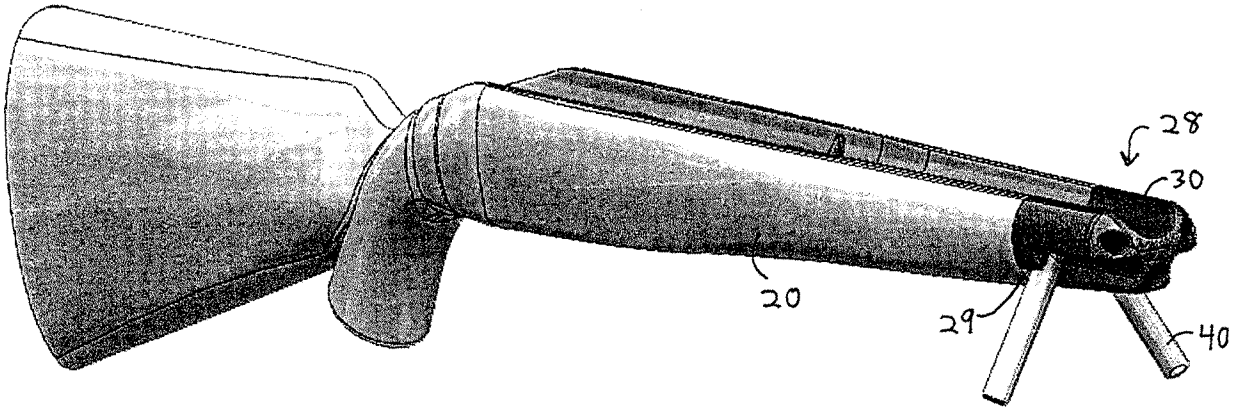
FIG. 10 is a perspective view of the mounting structure of FIG. 7 attached to a firearm stock, with the mounting structure in a use position.
Figure 11:
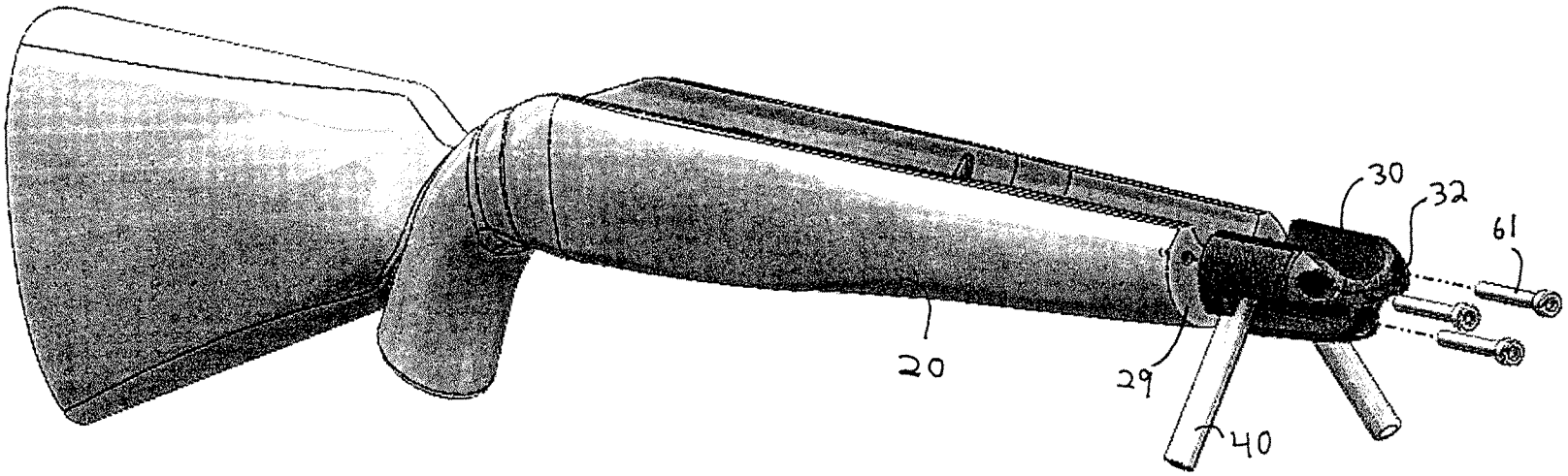
FIG. 11 is an exploded view of the mounting structure and firearm stock of FIG. 9, with the mounting structure in a use position.

In FIGS. 9 and 10, the embodiment of mounting structure 28 shown in FIGS. 7 and 8 is attached to a forearm 20 of a rifle 10. As shown in FIG. 11, the housing 30 is secured to the distal end 29 of the forearm 20 by threaded fasteners 61 passing through housing apertures 32 extending through the housing.

Figure 12:
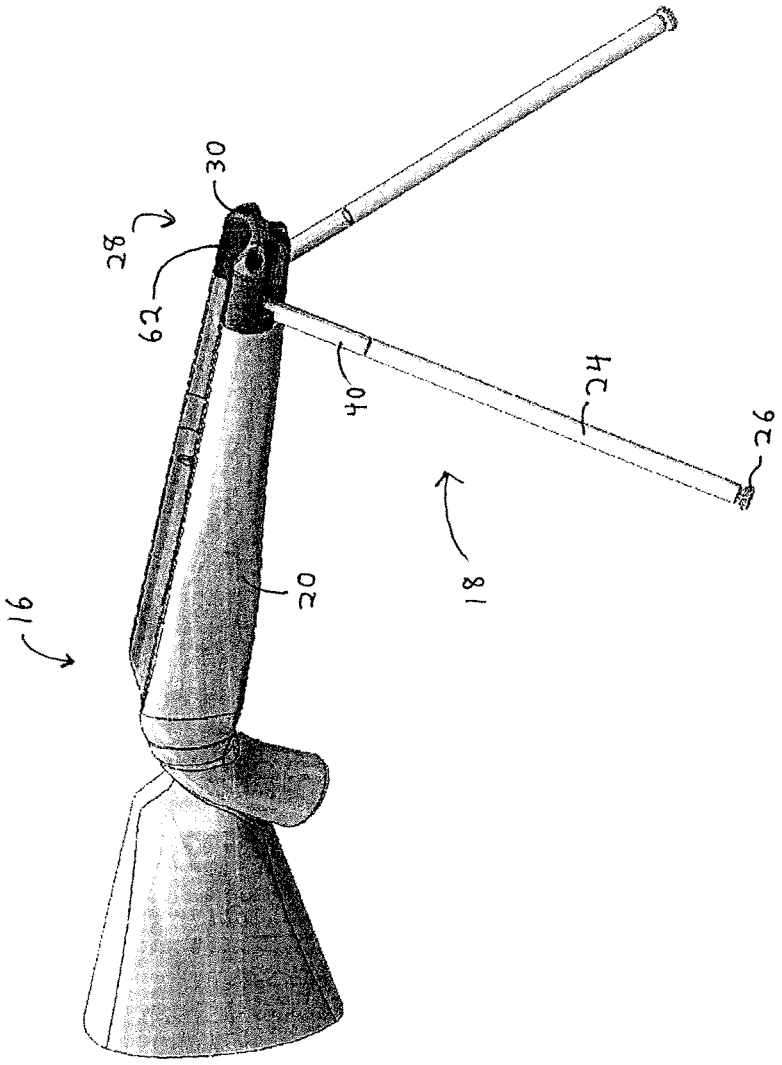
FIG. 12 is a perspective view of the mounting structure and firearm stock of FIG. 9, with the mounting structure in a use position and support legs attached to the mounting structure.

FIG. 12 shows the mounting structure 28 and stock 16 of FIG. 9 with support legs 24 attached to the receivers 40. In a completed rifle 10, a barrel 12 would rest in the indentation 62 at the top of the housing 30. The support legs 24 may be detached from the receivers 40 when the receivers are in a folded position, as shown in FIG. 9. Alternatively, the support legs 24 may remain attached to the receivers 40 when the receivers are in a folded position. After the support 18 is used in the use position shown in FIG. 12, the telescoping support legs 24 may be contracted and locked in the contracted position, and folded upward to be placed substantially parallel to the barrel 12. This allows the support legs 24 to be placed out of the way in situations when the support 18 is not in use, but removal and storage of the support legs 24 is not desired. For example, if a user has just used the support 18 to aim the rifle 10, and intends to walk a short distance before using the support 18 to aim the rifle 10 in a different location, it may be more convenient for the user to contract and fold the support legs 24, rather than to remove and store them. The support legs 24 may be contracted to decrease the distance the support legs extend from the housing 30.

In the embodiments shown in FIGS. 7-12, the placement of the mounting structure 28 on the distal end 29 of the forearm 20, rather than on the underside of the forearm 20, allows the support legs 24 to be close to the barrel 12 when the support 18 is in the folded position. Therefore, the placement of the mounting structure 28 on the distal end 29 of the forearm 20 allows the support 18 and stock 16 to be in a compact configuration, even when the support legs 24 remain attached to the mounting structure 28. In a folded position, if the support legs 24 remain attached to the receivers 40, the support legs 24 are substantially parallel to the barrel 12.

In the embodiments shown in the figures, the receivers 40 are cylindrical. However, in alternative embodiments, the receivers 40 may have non-cylindrical shapes. For example, the receivers 40 may be shaped as rectangular prisms.

The support legs 24 may be attached to the receivers 40 using various different devices or connectors. For example, each receiver 40 may include a spring and lock mechanism, such that the support leg 24 pushes against a spring when inserted into the receiver 40, and is locked in place when it reaches a certain point in the receiver 40. The support leg 24 could then be released by pushing the support leg 24 further into the receiver 40, such that the spring is further depressed and the lock is released. The spring may then provide force to aid in pushing the support leg 24 out of the receiver 40. Alternatively, each support leg 24 may attach to each receiver 40 using a socket device. The end 64 of each support leg 24 that is opposite to the end with the support foot 26 may comprise a female socket, while the receiver 40 may comprise a male socket, or vice versa. In another embodiment, the end 64 of each support leg 24 may be threaded, and each receiver 40 may be hollow, with a threaded interior. This configuration would allow the support leg 24 to be fastened to the receiver 40 by twisting the support leg 24 into the receiver 40.

Figure 13:
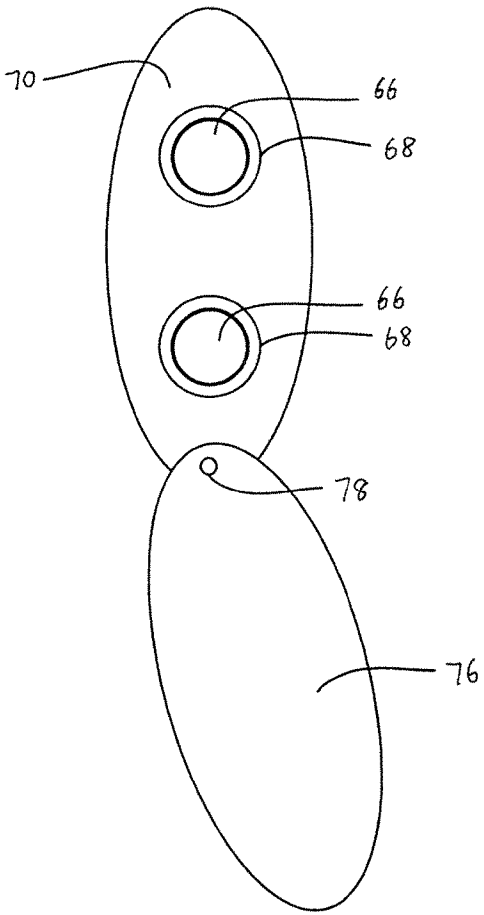
FIG. 13 is a rear view of the rifle of FIG. 1, with an open storage compartment.

A storage compartment comprising channels 66 (shown in FIG. 1) are included in the butt 22 of the stock 16. These channels are adapted to store the support legs 24 after they are removed from the receivers 40. In embodiments in which the support legs 24 are telescoping legs, the support legs 24 are contracted prior to storage. After the support legs 24 are removed from the receivers 40, they are pushed into the channels 66 through apertures 68, which are shown in FIG. 13. The apertures 68 are located in the end 70 of the stock 16, wherein the end 70 is the distal end of the butt 22 opposite from the forearm 20.

FIG. 13 shows the end 50 of the stock 16, including the channels 66 extending from the apertures 68. As shown in FIG. 1, the first portion 72 of each channel 66, which is proximate to the end 70 of the stock 16, is of a wider diameter than the second portion 74 of each channel 66, which extends from the first portion 72 further into the stock 16. The diameter of the first portion 72 is wider in order to accommodate a support foot 26 of a support leg 24, because the support feet 26 have a greater cross-sectional diameter than the support legs 24.

Figure 14:
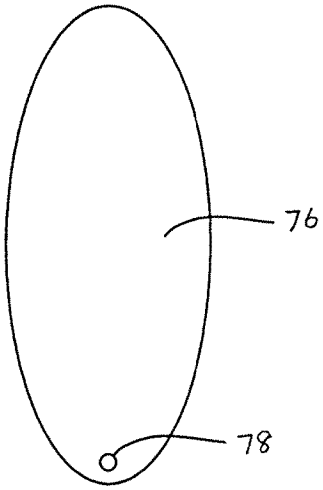
FIG. 14 is a rear view of the rifle of FIG. 1, with a closed storage compartment.

In FIG. 13, the storage compartment of the butt 22 of the stock 16 is open so that the support legs 24 may be inserted into the channels 66. The storage compartment is opened by pivoting the recoil pad 76 about a pivot pin 78, such that the recoil pad 76 is slid partially off of the end 70 of the stock 16 until it no longer covers the apertures 68. Alternatively, the recoil pad 76 may be completely removed from the end 70 of the stock 16. After the support legs 24 are inserted into the channels 66, the recoil pad 76 is moved back into position, such that the apertures 68 are covered, and secured to the end 70 of the stock 16. The recoil pad 76 may be secured to the end 70 of the stock 16 by any conventional means, such as by threaded fasteners. When the recoil pad 76 is moved back into position to cover the apertures 68, the storage compartment of the butt 22 of the stock 16 is closed, as shown in FIG. 14. Although the above description refers to a recoil pad 76, a buttplate may also be used to cover the apertures 68.

Figure 16:
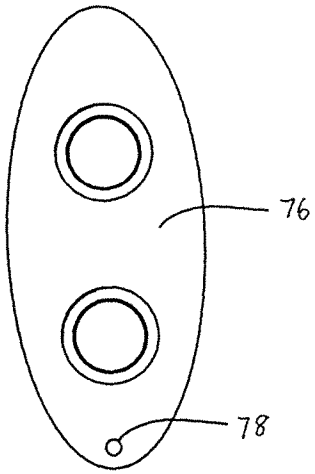
FIG. 16 is a rear view of the rifle of FIG. 15, with a closed storage compartment.
Figure 15:
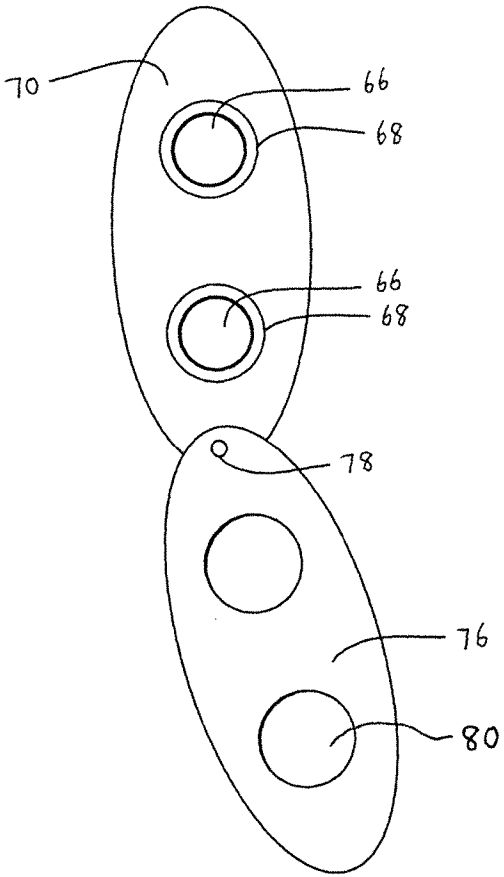
FIG. 15 is a rear view of a rifle of a fourth embodiment of the present invention, with an open storage compartment.

Alternatively, instead of using a recoil pad 76 to cover the apertures 68, recoil pad apertures 80 aligned with the apertures 68 and channels 66 may extend through the recoil pad 76, as shown in FIGS. 15 and 16. In such embodiments, the support legs 24 may be inserted through the recoil pad apertures 80, and therefore may be pushed into the channels 66 without removing the recoil pad 76, and without pivoting the recoil pad 76 away from the apertures 68. If a buttplate is used instead of a recoil pad 76, buttplate apertures aligned with the apertures 68 and channels 66 may extend through the buttplate, such that the support legs 24 may be inserted through the buttplate apertures without removing the buttplate, and without pivoting the buttplate away from the apertures 68.

In the embodiments shown in the figures, one channel 66 is included for each support leg 24. In, other embodiments, more than one support leg 24 may be included in a channel 66. For example, one channel 66 sized to contain two support legs 24 could be included in the butt 22 of the stock 16. However, it is preferable for channels 66 to be sized such that support legs 24 will fit snugly in the channels 66 without moving freely in the stock 16. Movement of support legs 24 within the stock 16 may have a negative effect on the balance of the firearm.

In the embodiments shown in the figures, the storage compartment in the butt 22 of the stock 16 includes two channels 66 for containing the support legs 24. However, a recess for the storage of mounting structure 28, or a portion of mounting structure 28, may also be included in the butt 22. Such a recess would be of use in embodiments of the invention in which the mounting structure 28, or a portion of the mounting structure 28, is removable. For example, if the hinge casing 43 (shown in FIG. 3) were removed from the connector 41, a recess to accommodate the storage of the hinge casing 43 and receivers 40 could be included in the butt 22. Such a recess could be included in addition to channels 66 for containing support legs 24, or the channels 66 could be replaced with one recess which is large enough to contain both the support legs 24 and components of the mounting structure 28.

To remove the support legs 24 from the channels 66, the rifle 10 may be tilted such that the end 70 of the stock 16 is tilted downward, thereby allowing the support legs 24 to slide out of the channels 66. Alternatively, each channel 66 may include a spring and lock mechanism, such that the support leg 24 pushes against a spring when inserted into the channel 66, and is locked in place when it reaches a certain point in the channel 66. The support leg 24 could then be released by pushing the support leg 24 further into the channel 66, such that the spring is further depressed and the lock is released. The spring may then provide force to aid in pushing the support leg 24 out of the channel 66. A lock mechanism for holding the support legs 24 in the channels 66 is especially useful in embodiments including recoil pad apertures 80, in order to prevent the support legs 24 from sliding out of the channels 66 during storage.

Although the figures depict a rifle 10, the stock 16 and support 18 of the present invention may also be used in connection with other firearms, such as but not limited to shotguns and handguns. The present invention may also be used in connection with crossbows or other hunting implements which include stocks or handles.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A firearm support system comprising:

a firearm stock having a forearm and a butt, the butt having a distal end opposite from the forearm, wherein the distal end of the butt comprises an aperture, and a channel extends from the aperture into the firearm stock; and a support comprising a support leg and a mounting structure for attaching the support leg to the forearm, wherein the support leg is detachable from the mounting structure, and wherein the channel is adapted to store the support leg after the support leg is detached from the mounting structure, wherein the mounting structure comprises a housing, a receiver adapted to receive the support leg, and a swivel mechanism, the housing comprising a cavity, wherein the receiver is capable of being folded from a position extending downward from the forearm to a position extending substantially parallel to a longitudinal axis of the forearm, and wherein at least a portion of the receiver is located in the cavity when the receiver is in the position extending substantially parallel to the longitudinal axis of the forearm, and wherein the swivel mechanism is adapted to allow the housing to be rotated about an axis which is substantially perpendicular to the forearm when the receiver is in the position extending downward from the forearm, and the swivel mechanism is adapted to allow the receiver to remain in place while the housing is rotated about said axis.

2. The firearm support system of claim 1, further comprising a recoil pad secured to the distal end of the butt of the firearm stock.

3. The firearm support system of claim 2, wherein a recoil pad aperture extends through the recoil pad, and wherein said recoil pad aperture is aligned with the channel.

4. The firearm support system of claim 2, further comprising a pivot pin extending through the recoil pad and into the distal end of the butt of the firearm stock.

5. The firearm support system of claim 1, wherein the receiver is threaded.

6. The firearm support system of claim 1, wherein the receiver comprises a spring and lock mechanism for securing the support leg within the receiver.

7. The firearm support system of claim 1, further comprising a channel spring and lock mechanism located in the channel for securing the support leg within the channel.

8. The firearm support system of claim 1, the forearm having a distal end opposite from the butt of the stock, wherein the mounting structure is mounted to the distal end of the forearm.

9. The firearm support system of claim 1, wherein the swivel mechanism is a ball joint.

10. A firearm support system comprising:

a firearm stock having a forearm and a butt, the butt having a distal end opposite from the forearm, wherein the distal end of the butt comprises a first aperture and a second aperture, and wherein a first channel extends from the first aperture into the firearm stock, and a second channel extends from the second aperture into the firearm stock; and a support comprising a first support leg, a second support leg, and a mounting structure for releasably attaching the first support leg and the second support leg to the forearm, wherein the first channel is adapted to store the first support leg after the first support leg is removed from the mounting structure, and the second channel is adapted to store the second support leg after the second support leg is removed from the mounting structure, wherein the mounting structure comprises a housing, a first receiver adapted to receive the first support leg, a second receiver adapted to receive the second support leg, and a swivel mechanism, the housing comprising a cavity, wherein the first receiver and the second receiver are capable of being folded from a position extending downward from the forearm to a position extending substantially parallel to a longitudinal axis of the forearm, and wherein at least a portion of the first receiver and at least a portion of the second receiver are located in the cavity when the first receiver and the second receiver are in the position extending substantially parallel to the longitudinal axis of the forearm, and wherein the swivel mechanism is adapted to allow the housing to be rotated about an axis which is substantially perpendicular to the forearm when the first receiver and the second receiver are in the position extending downward from the forearm, and the swivel mechanism is adapted to allow the first receiver and the second receiver to remain in place while the housing is rotated about said axis.

11. The firearm support system of claim 10, further comprising a recoil pad secured to the distal end of the butt of the firearm stock.

12. The firearm support system of claim 11, wherein a first recoil pad aperture and a second recoil pad aperture extend through the recoil pad, and wherein the first recoil pad aperture is aligned with the first channel, and the second recoil pad aperture is aligned with the second channel.

13. The firearm support system of claim 11, further comprising a pivot pin extending through the recoil pad and into the distal end of the butt of the firearm stock.

14. The firearm support system of claim 10, wherein the first receiver and the second receiver are each threaded.

15. The firearm support system of claim 10, wherein the first receiver comprises a first spring and lock mechanism for securing the first support leg within the first receiver, and the second receiver comprises a second spring and lock mechanism for securing the second support leg within the second receiver.

16. The firearm support system of claim 10, further comprising a first channel spring and lock mechanism located in the first channel for securing the first support leg within the first channel, and a second channel spring and lock mechanism located in the second channel for securing the second support leg within the second channel.

17. The firearm support system of claim 10, the forearm having a distal end opposite from the butt of the stock, wherein the mounting structure is mounted to the distal end of the forearm.

18. The firearm support system of claim 10, wherein the swivel mechanism is a ball joint.

19. The firearm support system of claim 10, the mounting structure further comprising a hinge casing connected to the swivel mechanism, said hinge casing comprising a first receiver hinge pin and a second receiver hinge pin, wherein the first receiver is connected to the first receiver hinge pin, and the second receiver is connected to the second receiver hinge pin.

* * * * *